United States Patent [19]

Williams et al.

[11] Patent Number: 4,771,820

[45] Date of Patent: Sep. 20, 1988

[54] STRIP CASTING APPARATUS AND METHOD

[75] Inventors: Robert S. Williams, Plum; Donald F. Baker, Hempfield, both of Pa.

[73] Assignee: Westinghouse Electric Corp., Pittsburgh, Pa.

[21] Appl. No.: 126,440

[22] Filed: Nov. 30, 1987

[51] Int. Cl.[4] ..... B22D 11/06

[52] U.S. Cl. ..... 164/463; 164/423

[58] Field of Search ..... 164/463, 479, 423, 429

[56] References Cited

U.S. PATENT DOCUMENTS 4,142,571 3/1979 Narasimhan .
4,221,257 9/1980 Narasimhan .
4,274,473 6/1981 Bedell et al. .
4,290,476 9/1981 Smith et al. .
4,307,771 12/1981 Draizen et al. .
4,475,583 10/1984 Ames .
4,489,772 12/1984 McLane .
4,502,528 3/1985 Frissora .
4,537,239 8/1985 Budzyn et al. .

FOREIGN PATENT DOCUMENTS 57-103763 6/1982 Japan ..... 164/423

*Primary Examiner*—Kuang Y. Lin
*Attorney, Agent, or Firm*—M. Moran

[57] ABSTRACT

Strip casting apparatus including a molten-metal-holding container and a nozzle to deposit molten metal onto a moving chill drum to directly cast continuous metallic strip. The nozzle body includes a slot bounded between a back and a front lip. The slot width exceeds about 20 times the gap distance between the nozzle and the chill drum surface. Preferably, the slot width exceeds 0.5 inch. This method of strip casting minimizes pressure drop, insuring better metal-to-chill-drum contact which promotes heat transfer and results in a better quality metallic strip.

12 Claims, 3 Drawing Sheets

STRIP CASTING APPARATUS AND METHOD

BACKGROUND OF THE INVENTION

The U.S. Government has a paid-up license in this invention and the right in limited circumstances to require the patent owner to license others on reasonable terms as provided for by the terms of contract No. DE-AC07-83-ID-12443 awarded by the U.S. Department of Energy.

FIELD OF THE INVENTION

The present invention relates generally to casting of metal and, more particularly, is concerned with planar flow casting of metallic strip.

DESCRIPTION OF THE PRIOR ART

Planar flow casting of metallic strip is disclosed in U.S. Pat. No. 4,142,571 for "Continuous Casting Method for Metallic Strips" and in U.S. Pat. No. 4,475,583 for "Strip Casting Nozzle", both of which patent specifications are incorporated herein by reference.

In planar flow casting, molten metal (which may be under pressure) is deposited onto the moving surface of a chill drum, chill wheel, chill roll, endless belt, or other chill body whereon the metal is solidified and then removed as a strip from the rotating drum. The process provides for direct and continuous casting of metal strips from the molten metal. A nozzle having a slot is used to transfer the molten metal from a container, such as a tundish or pouring box, to the moving chill drum. The nozzles are referred to as strip casting nozzles or planar flow casting nozzles.

Existing strip casting nozzle designs are characterized by slots having a width of less than 0.09 inch. For example, the slot of U.S. Pat. No. 4,142,571 has a width from about 0.2 to 1.01 millimeters (0.0078 to 0.039 inch), while the slot of U.S. Pat. No. 4,475,583 has a portion with a width from about 0.010 to 0.080 inch. Applicants discovered that such narrow-width slots restrict the flow of molten metal at a point removed from the surface of the chill drum which causes a large pressure loss in the molten metal from the container through the slot to the chill drum; that when molten metal is deposited on the moving chill drum surface with too low pressure, the heat of the molten and solidified portions of the metal is not efficiently transferred to the chill drum, and even local lift-off of the metal from the drum may result; and that as planar flow casting requires rapid cooling of the molten metal, improper heat transfer can result in poor strip properties.

What is needed is a planar flow apparatus design, based on Applicant's discovery, which minimizes the pressure drop of the molten metal from the container to the chill drum to increase the contact of the metal on the drum for efficient heat transfer to produce metallic strip of high quality.

SUMMARY OF THE INVENTION

It is an object of the invention to provide a planar flow apparatus design which minimizes the pressure drop of the molten metal through the nozzle.

It is another object of the invention to provide a strip casting method which will deposit molten metal onto a moving chill drum with good surface contact, so as to allow for efficient heat transfer.

To achieve the foregoing and other objects and in accordance with the purpose of the present invention as embodied and broadly described herein, the strip casting apparatus includes a chill body surface and a reservoir. The reservoir includes a molten-metal-holding container and a strip casting nozzle. The nozzle includes a through slot and a bottom surface. The bottom surface is spaced a predetermined distance from the chill body surface. The slot interconnects the container and the nozzle's bottom surface whereby the container's molten metal is delivered through the slot generally perpendicular onto the chill body surface. The slot's predetermined width is at least 20 times greater, at its minimum dimension, than the predetermined distance between the nozzle's bottom surface and the chill body surface at their nearest point.

In a second embodiment of the invention, the strip casting apparatus includes (a) a moving chill body surface, and (b) a reservoir for delivering molten metal onto a moving chill body surface. The reservoir includes (1) a container for holding the molten metal and (2) a strip casting nozzle. The strip casting nozzle includes a nozzle body having a slot, a front lip, and a spaced-apart back lip. The nozzle body is attached to the container, and the nozzle body is positioned to deliver molten metal through the slot perpendicularly onto the chill body surface. The slot is bounded by the two lips. The chill body surface moves from the back lip to the front lip. The front lip has a bottom, inner and outer surface. Each of the lips has a slot-facing inner surface, which is generally perpendicular to the chill body surface, and a bottom surface which faces the chill body surface. The distance between the lips is greater than about 20 times the closest distance between the chill body surface and each bottom surface of the lips.

In a third embodiment of the invention, the method for casting continuous metallic strip includes orienting the nozzle slot generally perpendicular to the chill body surface, positioning the nozzle such that the slot width is greater than about 20 times the distance from the nozzle to the chill body surface, passing the molten metal through the slot onto the chill body surface, moving the chill body surface, and cooling the molten metal on the chill body surface to solidify the molten metal into the continuous metallic strip.

In a preferred embodiment of the invention, the distance between the lips is greater than about 0.5 inch.

Several benefits and advantages are derived from the invention. The apparatus of the invention minimizes the pressure drop of the molten metal through the slot, which increases the contact of the metal with the chill body surface, which increases the heat transfer, which results in metallic strip of good quality being produced. Also, freeze-up or clogging of the nozzle slot due to inclusions is less likely to occur, and more likely to be overcome, by using the method of the invention.

DESCRIPTION OF THE DRAWINGS

The invention will become more readily apparent from the following description of preferred embodiments thereof shown, by way of example only, in the accompanying drawings, wherein.

DESCRIPTION OF THE PREFERRED EMBODIMENTS

Figure 1:
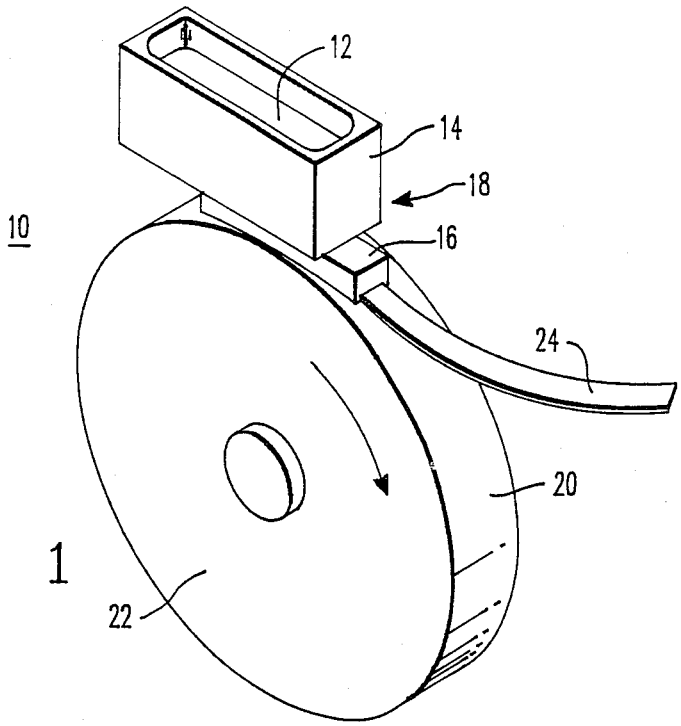
FIG. 1 is a schematic diagram of a strip casting apparatus showing the molten-metal-holding container, the nozzle, and the chill drum.

Reference will now be made in detail to several present preferred embodiments of the invention, some examples of which are illustrated in the accompanying drawings. In the drawings, like reference characters designate like or corresponding parts throughout the several views.

Figure 2:
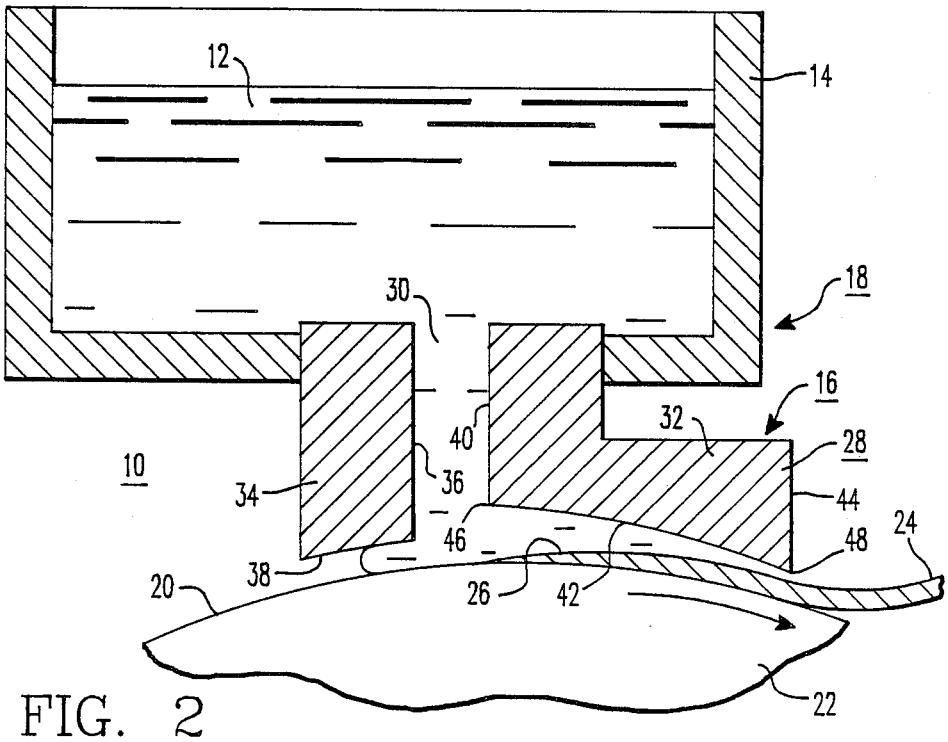
FIG. 2 is an elevational view, partly in section, of the apparatus of FIG. 1.

Referring to FIGS. 1 and 2, the strip casting apparatus 10 is shown in operation. Molten metal 12, such as steel, flows, under hydrostatic pressure, from the container 14, such as a tundish or pouring box, through the strip casting nozzle 16, the container 14 and the nozzle 16 together being referred to as the reservoir 18, and onto the surface 20 of the moving chill drum 22 sometimes referred to as a chill wheel, chill roll, endless belt, or other chill body, which is kept cold, i.e., colder than the melting point of the molten metal 12, in a manner well known to those skilled in the art. The molten metal 12 is quickly cooled on the moving chill drum 22, changing into a solid metallic strip 24 along a solidification surface 26. As can be appreciated by the artisan, the metallic strip 24 is removed from the chill drum 22 in a continuous manner.

Figure 3:
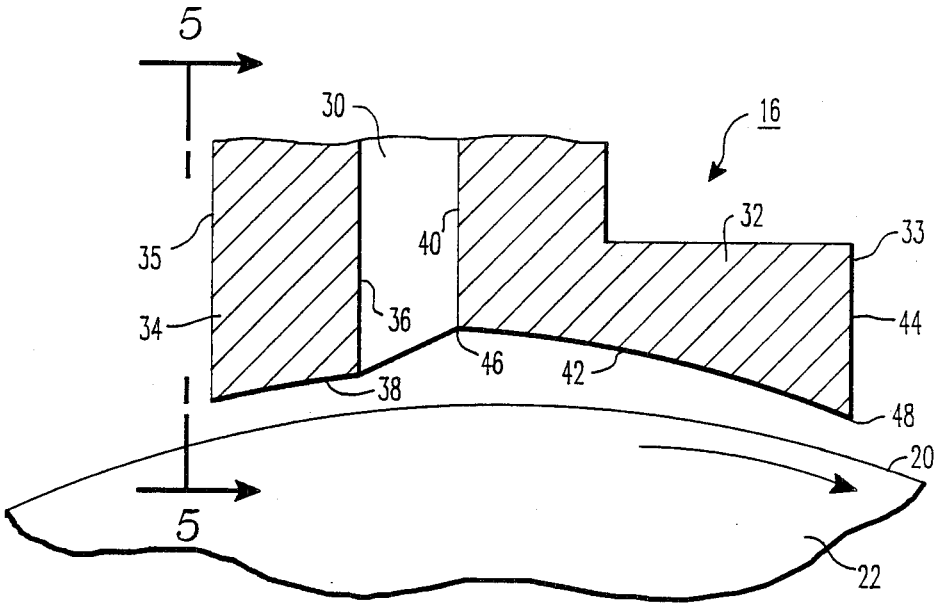
FIG. 3 is an enlarged sectional view of a portion of the nozzle and the chill drum of FIG. 2.
Figure 4:
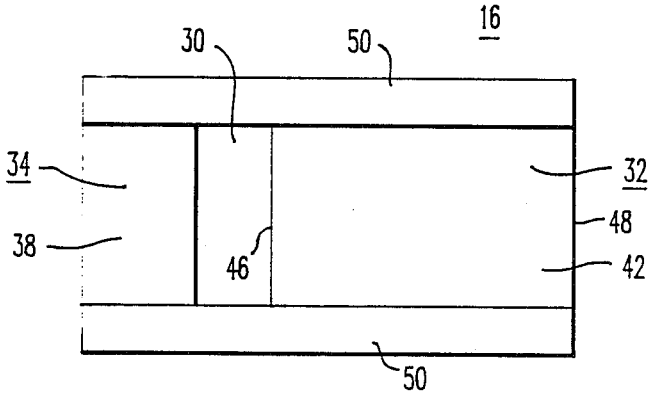
FIG. 4 is a bottom plan view of the nozzle.
Figure 5:
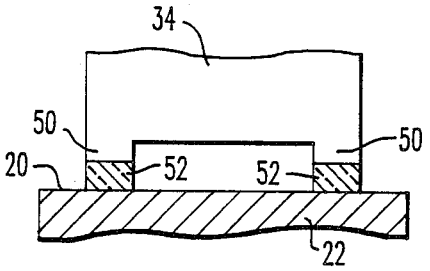
FIG. 5 is a back view of the nozzle and a cross section portion of the chill drum taken along lines 5—5 of FIG. 3, with the addition of a ceramic paper gasket to the sides of the nozzle.

As shown more clearly in FIGS. 3, 4, and 5, the strip casting nozzle 16 includes a nozzle body 28 having a through slot 30, a front lip 32, and a spaced-apart back lip 34. The slot 30 is bounded front and back by the front and back lips 32 and 34. The front lip 32 is considered to be that portion of the nozzle body 28 which extends from the slot 30 to the front end 33 thereof, while the back lip 34 is that portion of the nozzle body 28 which extends from the slot 30 to the rearward end 35. "Front" and "back" are reference terms chosen such that the moving surface 20 of the chill drum 22 moves in a direction from the back lip 34 to the front lip 32.

The nozzle body 28 is communicably attached to the container 14 so that molten metal 12 can flow through the slot 30. The term "attached" includes a separate nozzle body attached to the container as well as a nozzle body which is integral with the container, i.e., a reservoir of unitary construction. The nozzle body 28 is disposed, with respect to the chill drum 22, so that the molten metal 12 flowing through the slot 30 from the container 14 is deposited generally perpendicularly onto the chill drum 22.

The back lip 34 of the nozzle body 28 has an inner surface 36 and a bottom surface 38. The inner surface 36 faces generally the back of the slot 30 and is generally perpendicular to the chill drum surface. The bottom surface 38 faces the chill drum surface 20. Likewise, the front lip 32 of the nozzle body 28 has an inner surface 40 and a bottom surface 42. The inner surface 40 faces generally the front of the slot 30 and is generally perpendicular to the chill drum surface 20. The bottom surface 42 faces the chill drum surface 20.

The gap distance is defined as the perpendicular distance from the closest point on each of the bottom surfaces 38 and 42 of the lips 32 and 34 to the chill drum surface 20. The slot width is defined as the perpendicular distance from any point on the inner surface 36 of one of the lips 34 to the inner surface 40 of the other one of the lips 32. In Applicants' invention, the slot width is greater than about 20 times the gap distance. It is noted that the slot width may vary at different points along the inner surfaces of the nozzle body 28 as long as the slot-width-to-gap-distance ratio, for any point on an inner surface, always is greater than or equal to 20. A recommended range for the ratio of the slot width to the gap distance is from about 25 to 200. Preferably, the slot width exceeds about 0.5 inch, and an exemplary slot width is one from about 1 to 24 inches. The strip casting apparatus design of the invention minimizes the pressure drop of the molten metal 12 through the slot 30 which provides for good surface contact between the metal, molten metal 12 and solidified metal 24 portions, and the chill drum surface 20 which improves the heat transfer rate as well as the surface quality of the resulting metallic strip 24.

The front lip 32 also has an outer surface 44. An imaginary line perpendicular to the outer surface 44 forms an acute angle with respect to the direction of motion of the chill drum surface 20 at the point of molten metal deposition on such surface. Preferably, the outer surface 44 faces generally in the direction of motion of the chill drum surface 20. The inner and bottom surfaces 40 and 42 intersect at an inner edge 46, and the bottom and outer surfaces 42 and 44 intersect at an outer edge 48. Each such edge may be a radiused edge having a radius of, for example, about one-eighth inch.

The inner surfaces 40 and 36 of the lips 32 and 34 can bound a slot 30 having an oval or other shape rather than the rectangular shape shown in FIG. 4. For example, the inner surface 40 of the front lip 32 may be concave in shape, looking down into the slot 30 from the top, to compensate for edge effects of the metal flow so as to produce strip of uniform thickness.

Preferably, for the front lip 32, the distance from the inner edge 46 to the chill drum surface 20 is greater than the distance from the outer edge 48 to the chill body surface 20. With this feature, the flow of molten metal 12 is restricted at a point on the chill drum 22 by the gap between the outer edge 48 and the chill drum surface 20. In an exemplary embodiment, the bottom surface 38 has a concave shape.

Figure 6:
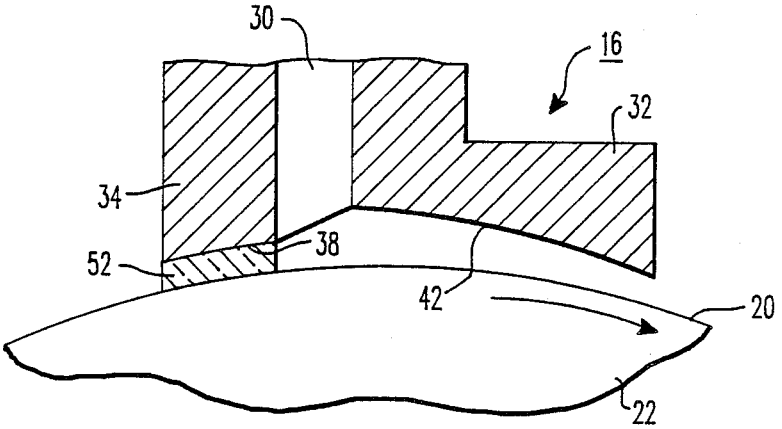
FIG. 6 is a side elevational view partly in section, similar to FIG. 3 with the addition of a ceramic paper gasket to the back lip of the nozzle.

Depending on the application, the front and back lips 32 and 34 can have side portions 50, sideways bounding the slot 30, which extend lower than the bottom surfaces 42 and 38 of the lips 32 and 34 (see FIG. 5), to better contain the molten metal 12, as can be appreciated by those skilled in the art. Also, these side portions 50, as well as the bottom surface 38 of the back lip 34, may have resilient gaskets, such as ceramic paper gaskets 52, compressibly contacting the chill drum surface 20 to further contain the molten metal flow (see FIGS. 5 and 6).

In a test run of the apparatus of the invention, 0.547 pounds of low-carbon, silicon-killed steel were induction melted and pressurized with 0.5 psig argon. The boron nitride nozzle, having a 0.750 inch diameter generally circular slot and a concave tapered front lip 32, was oriented generally perpendicular to the chill drum surface 20 and positioned to leave a gap therebetween of 0.014 inch for the back lip's bottom surface 38, 0.058 inch for the inner edge 46 of the front lip's bottom surface 42, and 0.028 inch for the outer edge 48 of the front lip's bottom surface 42. The molten metal (heated to about 1,615 degrees C) was passed through the slot onto the chill drum surface, the chill drum being a 14.2-inch-diameter, 1.2-inch-wide OFHC (oxygen free high conductivity) copper solid wheel rotating at 150 rpm and having a before-run temperature of 72 degrees C. A fiberfax gasket 52 was used between the nozzle and the moving chill drum surface. The molten metal cooled and solidified on the moving chill drum surface producing a continuous metallic strip which was 0.020 to 0.025 inches thick and 0.75 inches wide.

The above-described elements of the planar flow apparatus work together to produce a continuous direct casting metallic strip. It is clear other dimensions of the elements, such as the length of the front lip 32 as well as the casting operating parameters, such as the speed of the moving chill drum surface 20 are to be chosen to best meet the demands of the particular metallic strip composition, thickness, etc., as is within the purview of those skilled in the art.

It will be apparent that many modifications and variations are possible in light of the above teachings. It, therefore, is to be understood that within the scope of the appended claims, the invention may be practiced other than as specifically described.

We claim:

1. A strip casting apparatus comprising:

a chill body surface; and a molten-metal-containing reservoir associated with said chill body surface for depositing molten metal thereon, said reservoir including a container for holding molten metal and a strip casting nozzle, said strip casting nozzle including a slot therethrough of predetermined width and a bottom surface, said bottom surface being spaced a predetermined distance from said chill body surface and said slot interconnecting said container and said bottom surface of said nozzle whereby molten metal from said container is delivered through said slot generally perpendicular onto said chill body surface, said predetermined width of said slot being at least 20 times greater, at its minimum dimension, than said predetermined distance between the bottom surface of said nozzle and said chill body surface at their nearest point, wherein said predetermined width of said slot exceeds about 0.5 inch.

2. Strip casting apparatus comprising:

(a) a movable chill body surface; and (b) a molten-metal-containing reservoir, for depositing molten metal onto said chill body surface, having a container for holding said molten metal, and a strip casting nozzle including:

a nozzle body having a through slot, said nozzle body communicably attached to said container and disposed, with respect to said chill body surface, such that said molten metal from said container is delivered through said slot generally perpendicularly onto said chill body surface, said nozzle body also having a front lip and a spaced-apart back lip bounding therebetween said slot, with said chill body surface movable in a direction from said back lip to said front lip, said lips each having a bottom surface and a slot-facing inner surface, wherein each said bottom surface faces said chill body surface, each said inner surface is generally perpendicular to said chill body surface, and a first perpendicular distance from any point on said inner surface of one of said lips to said inner surface of the other of said lips is greater than about 20 times a second perpendicular distance from said chill body surface to a point, on said bottom surface of each of said lips, closest to said chill body surface, wherein said first perpendicular distance exceeds about 0.5 inch.

3. The strip casting apparatus of claim 2, wherein said front lip also has an outer surface intersecting its said bottom surface at an outer edge with its said slot-facing inner surface intersecting its said bottom surface at an inner edge, wherein the distance from said inner edge perpendicular to said chill body surface is greater than the distance from said outer edge perpendicular to said chill body surface, wherein a normal to said outer surface forms an acute angle with respect to the direction of motion of said chill body surface, and wherein said bottom surface of said front lip has a generally concave shape.

4. The strip casting apparatus of claim 2, wherein said bottom surface of said back lip has a resilient gasket which compressibly contacts said chill body surface.

5. The strip casting apparatus of claim 2, wherein said first perpendicular distance is from about 25 to 200 times said second perpendicular distance.

6. The strip casting apparatus of claim 5, wherein said first perpendicular distance is from about 1 to 24 inches.

7. The strip casting apparatus of claim 6, wherein said front lip also has an outer surface intersecting its said bottom surface at an outer edge with its said slot-facing inner surface intersecting its said bottom surface at an inner edge, wherein the distance from said inner edge perpendicular to said chill body surface is greater than the distance from said outer edge perpendicular to said chill body surface, wherein a normal to said outer surface forms an acute angle with respect to the direction of motion of said chill body surface, and wherein said bottom surface of said front lip has a generally concave shape.

8. The strip casting apparatus of claim 7, wherein said bottom surface of said back lip has a resilient gasket which compressibly contacts said chill body surface.

9. The strip casting apparatus of claim 8, wherein said gasket includes a ceramic paper.

10. A method, for casting continuous metallic strip from molten metal, comprising the following steps:

(a) orienting a slot of a nozzle generally perpendicular to a chill body surface;

(b) disposing said nozzle a distance from said chill body surface such that the width of said slot is greater than about 20 times said distance, wherein the width of said slot exceeds about 0.5 inch;

(c) passing said molten metal through said slot onto said chill body surface;

(d) moving said chill body surface at a predetermined speed; and (e) cooling said molten metal on said moving chill body surface to solidify said molten metal into said continuous metallic strip.

11. The method of claim 10, wherein said disposing step disposes said nozzle a said distance from said chill body surface such that the width of said slot is from about 25 to 200 times said distance.

12. The method of claim 11, wherein the width of said slot is from about 1 to 24 inches.

* * * * *